United States Patent [19]

Holan

[11] Patent Number: 4,891,862

[45] **Date of Patent: * Jan. 9, 1990**

[54] HINGE

[76] Inventor: Leif A. Holan, P.O. Box 3527, Clear Lake Highlands, Calif. 95422

[ * ] Notice: The portion of the term of this patent subsequent to Apr. 11, 2006 has been disclaimed.

[21] Appl. No.: 302,914

[22] Filed: Jan. 30, 1989

Related U.S. Application Data

[63] Continuation-in-part of Ser. No. 138,142, Dec. 28, 1987, Pat. No. 4,819,299.

[51] Int. Cl.[4] ..... F05F 1/12

[52] U.S. Cl. ..... 16/278; 16/296; 16/297; 16/303; 16/333; 16/334; 16/342; 16/347; 16/380; 16/389; 16/72; 16/DIG. 13; 16/385

[58] Field of Search ..... 16/71, 72, 74, 228, 16/277, 278, 284, 285, 291, 293, 296, 303, 307, 321, 332, 333, 335, 337, 339, 341–343, 347, 380, 385, 386, 387, DIG. 13

[56] References Cited

U.S. PATENT DOCUMENTS

| | | | |
|---|---|---|---|
| 3,550,187 | 12/1970 | Swartz | 16/335 |
| 3,568,241 | 3/1971 | Uffner | 16/321 |
| 3,632,185 | 10/1971 | Cartwright et al. | 16/335 |
| 3,722,030 | 3/1973 | Smith | 16/303 |
| 3,728,757 | 4/1973 | Lloyd | 16/303 |
| 3,822,440 | 7/1974 | Stansbury, Jr. et al. | 16/303 |
| 3,835,585 | 9/1974 | Anderson et al. | 16/335 |
| 3,837,043 | 9/1974 | Coe | 16/303 |
| 3,931,663 | 1/1976 | Holmes | 16/DIG. 13 |
| 4,819,299 | 4/1989 | Holan | 16/278 |

*Primary Examiner*—Nicholas P. Godici
*Assistant Examiner*—Edward A. Brown
*Attorney, Agent, or Firm*—Frederick E. Mueller

[57] ABSTRACT

A self-closing hinge comprises a pair of hinge leaves pivotally interconnected by an offset hinge pin. One leaf has a flanged head projecting substantially radially with respect to a sleeve of the other hinge leaf, within which the hinge pin is mounted. The external surface of the sleeve serves as a cam surface against which a follower element carried on the head of the other leaf is biased. The cam follower comprises a tubular spring-steel member oriented parallel to the hinge pin and generates a force through the head of the other leaf along an axis distally offset relative to the axis of the hinge pin. During closing of the hinge the follower is brought into registration with a pocket formed in the sleeve to effect a rocking movement of the follower about one edge of the pocket to generate a self-closing moment.

19 Claims, 3 Drawing Sheets

HINGE

The present application is a continuation-in-part of copending application Ser. No. 138,142, filed Dec. 28, 1987, and now U.S. Pat. No. 4,814,299.

BACKGROUND OF THE INVENTION

The present invention relates to hinges and, more particularly, to a self-closing hinge.

SUMMARY OF THE INVENTION

In its preferred embodiment, the hinge of the invention comprises a fixed leaf and swingable leaf, pivotally interconnected by an offset hinge pin. One of the leaf members has a flange adapted to mount a tubular spring steel cam follower parallel to the hinge pin that is biased against a cam surface of the other leaf.

More particularly, the fixed leaf has a planar base portion formed with a flange along one edge which includes a partially cylindrical cam sleeve to journal a central portion of the hinge pin. The partial sleeve defines a relief pocket for one edge of the cam follower. The flange may also include opposite side ear portions oriented to define keepers to prevent axial displacement of the hinge pin out of the assembled hinge. The planar base portion of the fixed leaf is preferably formed with a central clearance or relief space adapted to register with a base portion of the swingable leaf when the hinge is closed. The fixed leaf may also have other integral portions formed in a configuration adapted for seating on the frame of the opening in which the hinge is to be mounted.

The swingable leaf has a planar base portion that along one edge is formed with a spaced apart pair of flanges having integrally formed hinge pin knuckles. In a central portion of its base, the swingable leaf is integrally formed with a generally U-shaped flange that is in parallel offset relation to the common plane of the adjacent pair of flanges. The legs of the U-shaped flange provide a pair of retainers at opposite sides of a head portion of the flange between which the cam follower is held against axial displacement while the flange head is seated within a pocket of the follower. The pocket of the cam follower has shape characteristics that, during final closing or initial opening movement of the hinge, accommodate rocking action of the follower relative to its seat on the flange head, the head having a radius similar to that of a concave seat of the follower. Alternatively, the edge of the flange head may be flat and have line contact with an arcuately shaped convex ridge defining the seat of the follower.

The follower is preferably made of a short length of a spring-steel tube. A cam engaging concave face is defined along one side of the follower opposite to its pocket and has a radius like that of the cam surface against which it is biased by the resilience of the follower when the hinge is in an open condition.

DESCRIPTION OF THE DRAWINGS

FIG. 5 is a top plan view of a pair of the hinges of the invention schematically shown as supporting an adjacent pair of cabinet doors over a framed opening of a cabinet or the like.

DESCRIPTION OF THE PREFERRED EMBODIMENTS

Figure 1:
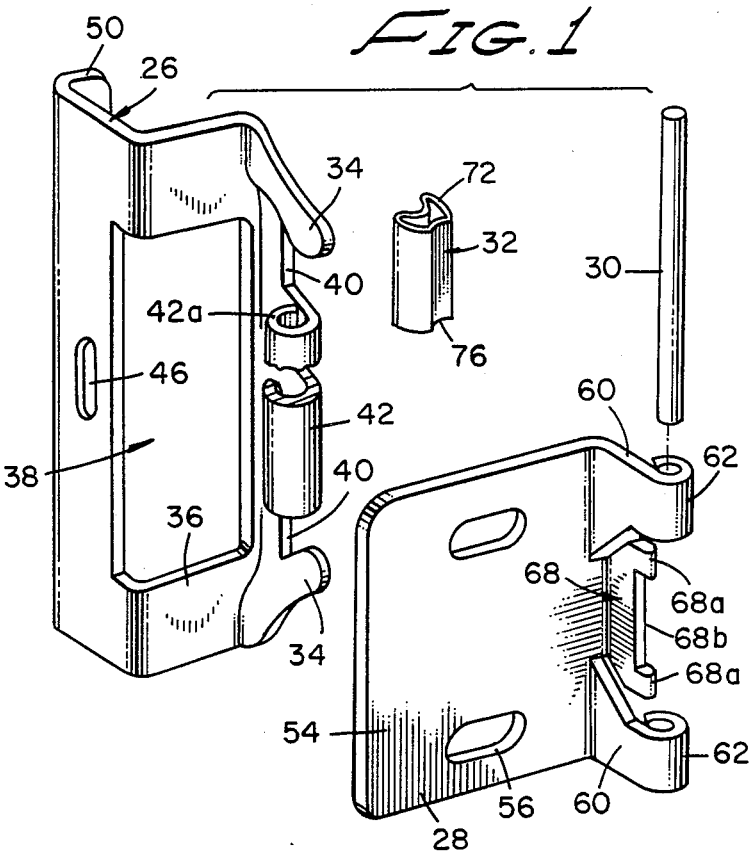
FIG. 1 is an exploded perspective view of the four components of the preferred embodiment of the invention.

Before explaining the invention in detail, it is to be understood that it is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 5:
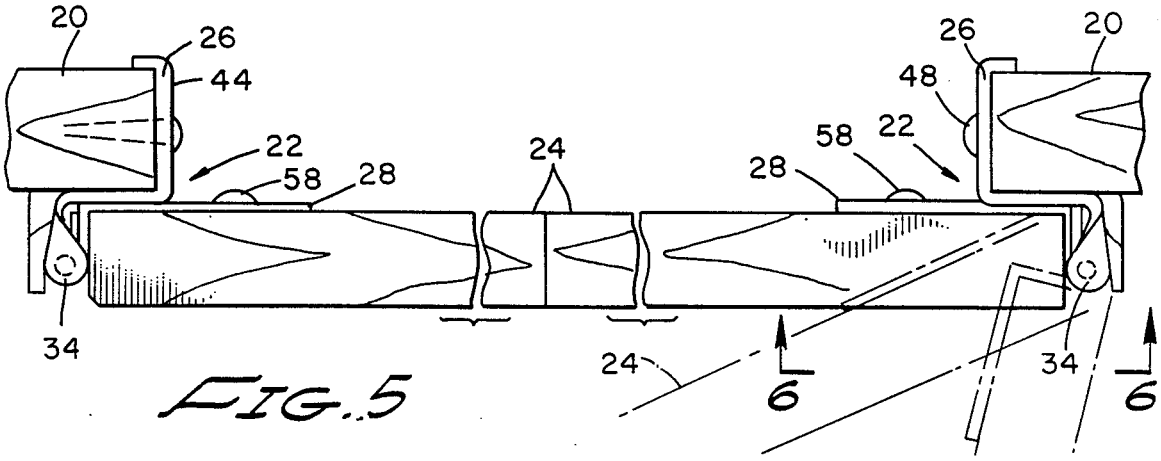

FIG. 5 schematically depicts an opening in a cabinet or the like, opposite vertical edges of which are framed by members 20. The hinge assembly of the invention is indicated by the reference numeral 22 and it will be understood that at least a pair of the hinge assemblies 22 are fitted to each of the frame members 20 to support one of a pair of doors 24, which can be individually opened and closed relative to the opening of the cabinet.

Figure 2:
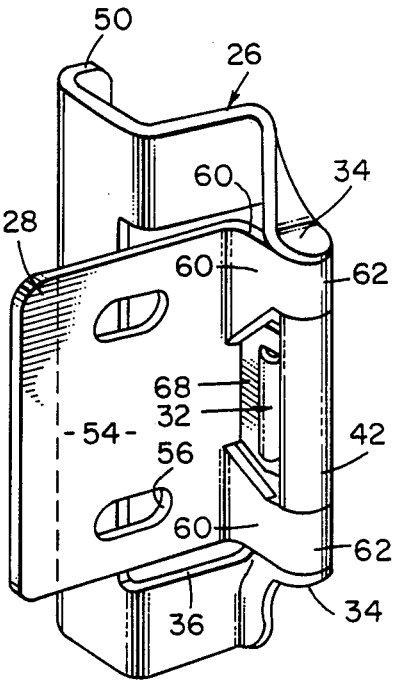
FIG. 2 is a perspective view of the assembled components of the invention.

Referring to FIGS. 1 and 2, an assembly 22 comprises a fixed leaf 26, a swingable leaf 28, a hinge pin 30 and a follower 32. In the illustrated embodiment, the parts 26, 28 may be economically produced out of a synthetic plastic material while the hinge pin 30 may comprise an appropriate length of steel rod of appropriate diameter. The follower 32 may be made, e.g., by extrusion of a cylindrical steel tube into substantially the cross sectional configuration of FIG. 10, which is cut to an appropriate length and thereafter tempered to achieve the desired resilience.

Figure 6:
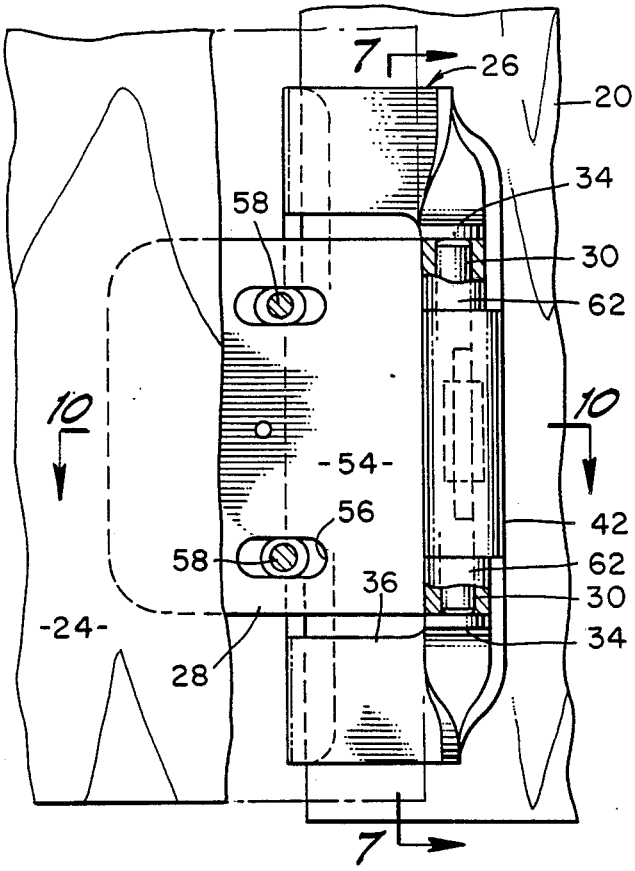
FIG. 6 in an elevational view taken on the line 6—6 of FIG. 5, portions being broken away to illustrate certain details of construction.
Figure 7:
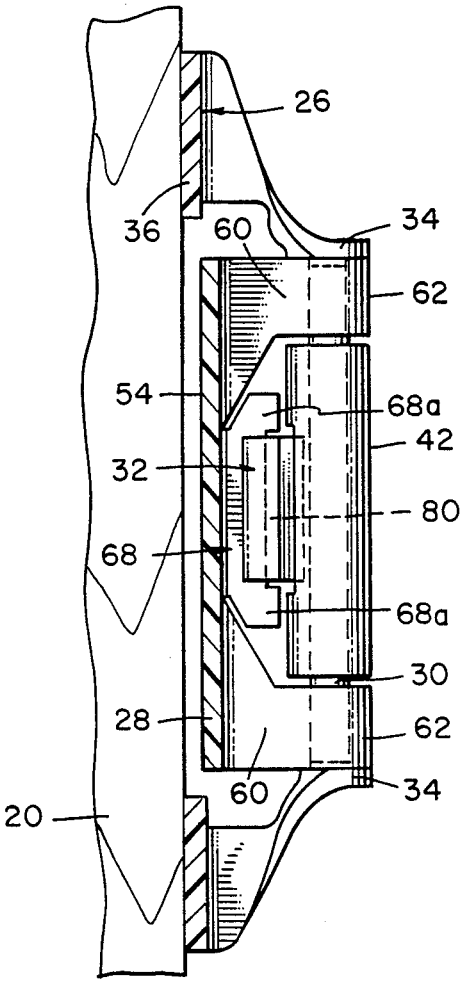
FIG. 7 is a sectional view taken on line 7—7 of FIG. 6.

More specifically, the fixed leaf 26 comprises a planar base portion 36 adapted to seat on a face of the cabinet opening frame. In the illustrated case, an essentially rectangular opening 38 is defined in the base to provide a clearance space for the action of the swingable leaf 28, which may be required in some cases. Along the hinge pin or distal side of the leaf 26 the material of the base develops into an integral upstanding flange 40 extending over the width of the piece. A medial portion extension of the flange 40 defines an integral partial cam sleeve 42 flanked by fully closed sleeves **42*a* of an inner diameter to journal the hinge pin 30. The opposite ends of the flange 40 have symmetrical outwardly projecting ears 34 which can be formed, e.g., thermoplastically bent and folded, into the attractive finished configuration illustrated in FIGS. 2 and 6, wherein the pair of ears neatly confine the hinge pin 30** against axial displacement out of the assembly.

As will be apparent, the base 36 could be secured to the cabinet frame opening merely by means of appropriate fasteners penetrating holes in the base. However, in the illustrated embodiment the fixed leaf 26, along its proximal side opposite to the flange 40, is formed into a generally channel-shaped configuration comprising a face plate 44 having a vertically elongate slot 46 formed therethrough for the reception of an appropriate fastener 48, such as shown in FIG. 5. A short flange 50 may be provided along the edge of face plate 44 in parallel opposition to base portion 36 to abut the inside of the cabinet frame member.

The swingable leaf 28 comprises a base portion 54 of a width slightly less than the corresponding dimension of the opening 38 in the fixed leaf 26. Along a pair of opposite sides the base 54 is formed with an elongate parallel pair of fastener openings 56 to receive appropriate fasteners 58 for securing the leaf to the corresponding door, as illustrated in FIG. 5. Along its distal or hinge side, the swingable leaf 28 includes an upstanding spaced apart symmetrical pair of upright co-planar flanges 60 the free ends of which define a co-axial pair of cylindrical knuckles or sleeves 62 adapted to seat opposite end portions of the hinge pin 30.

At a mid portion of the base 54 of the swingable leaf, between the flanges 60, there is an integral upstanding flange or head 68 that is distally parallel and offset relative to the common plane of the adjacent pair of flanges 60. The arrangement is such that the medial plane of the head 68 is distally offset relative to axis of the hinge pin when the parts are assembled. The flange 68 is generally U-shaped in configuration, having a pair of tab extensions **68*a* on opposite sides of a web portion 68*b*. The space between the confronting edges of the head extensions 68*a* is slightly greater than the overall length of the follower 32** to be mounted therebetween, as will presently be described.

Figure 3:
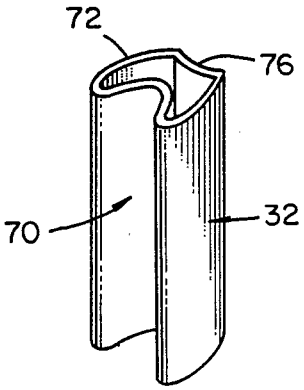
FIG. 3 is a perspective view of the cam follower component of the invention, rotated 90° about its long axis with respect to its representation in FIG. 1.

Referring to FIG. 3, the follower 32 comprises a length of thin-walled spring steel tubing having, in its relaxed state, a symmetrical pair of convex side walls 72, a flattened generally U-shaped pocket 70, and a concave face 76 opposite to the pocket 70. The configuration of the follower shown in FIG. 10 closely approximates its relaxed shape. The overall length of the follower 32 is such that, as the follower rocks or pivots relative to the head 68 against which it is seated, the opposite ends of the follower are moveable with a slight clearance relative to the confronting edges of the gap defined between the tabs **68*a* of the head 68**.

Figure 4:
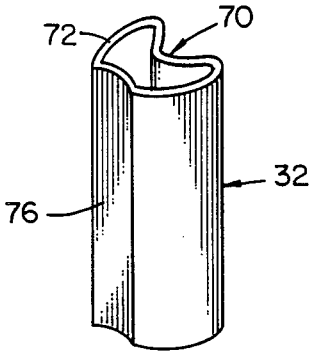
FIG. 4 is a perspective view of the component of FIG. 3 but rotated 180° on its long axis.

Referring to FIG. 4, the face 76 of the follower 32 is formed in the shape of an arcuate depression having a radius substantially matingly similar to the radius of the outer or cam surface of the cam sleeve 42 of the fixed leaf 26.

Figure 8:
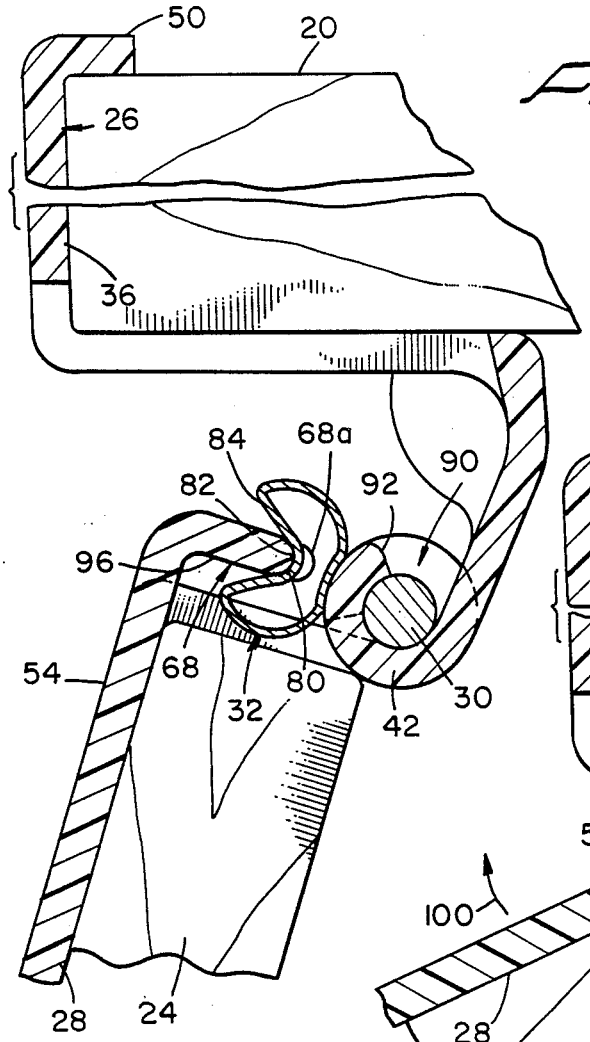
FIGS. 8, 9 and 10 are schematic sectional views taken on the line 10—10 of FIG. 6 but showing the two leafs of the hinge in different relative positions.
Figure 9:
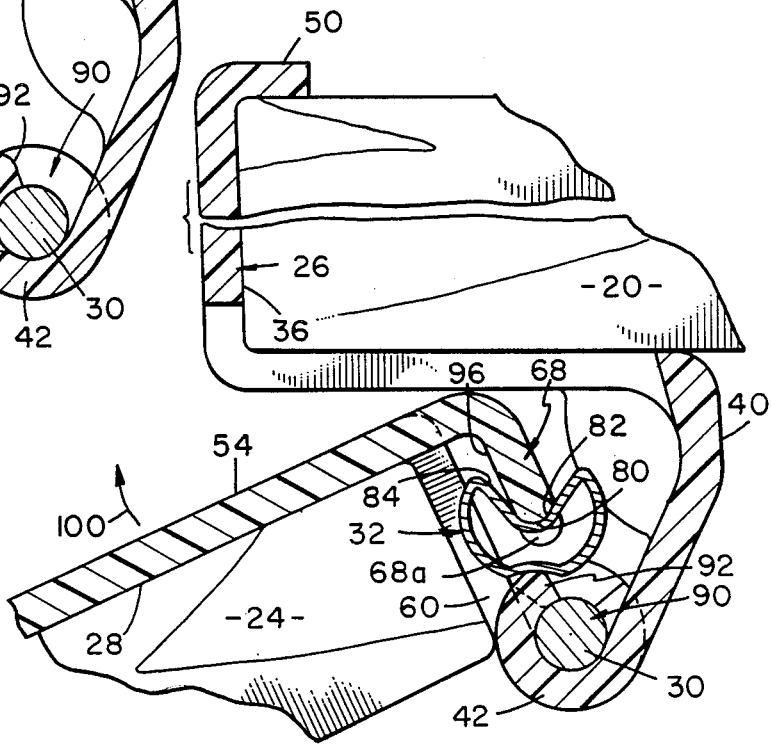
Figure 10:
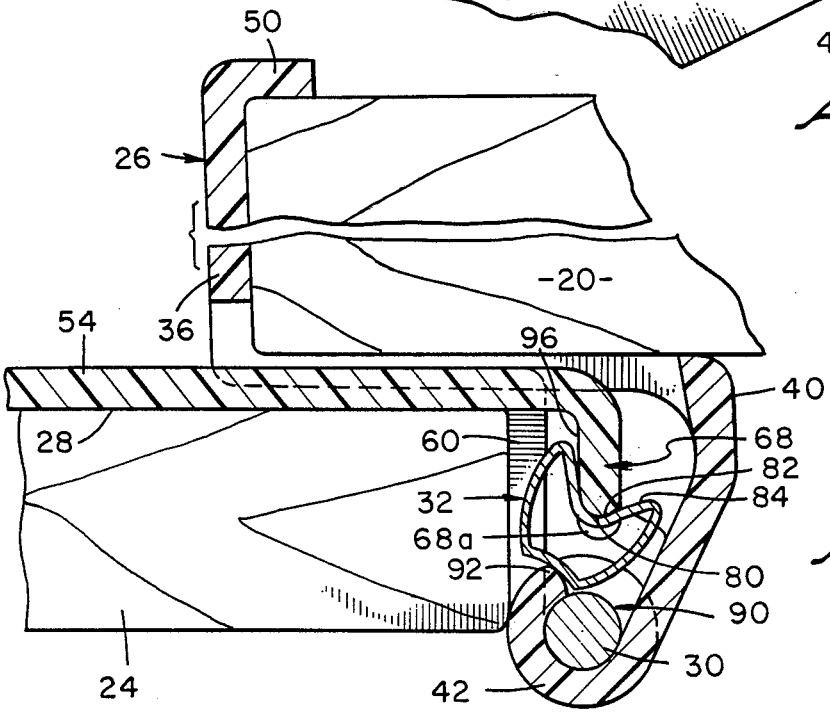

The terminal edge 80 of the head portion **68*b* is formed into a semi-cylindrical surface having a diameter of the thickness of the material of the head 68. Similarly, as seen in FIGS. 8 through 10, the bottom of the pocket 70 of the follower 32 is formed with a concave seat 82 of a radius similar to that of the edge 80, while the opposite internal sides 84 of the pocket flare divergently outwardly from seat 82 towards the mouth of the pocket 70. Clearance is thus provided within the pocket 70 for rocking movement of the follower 32 relative to the head 68**.

As indicated in FIG. 10, the cam surface 42 extends through less than 360°, e.g., through about 270°, to define an internal pocket 90 into which one distal edge of the concave face 76 of follower 32 can be tilted when the hinge is in the fully closed condition. At the same time, a radiused terminal edge 92 of the outer surface of the cam 42, which defines one side of the pocket 90 is engaged with the face 76 while the follower 32 is held under radial compression between the edge 92 of the cam surface and the rounded edge 80 of the head 68. In this connection, it should be understood that in the FIG. 10 condition the follower 32 is illustrated in a partially stressed condition of radial compression and not in a relaxed state.

As has been noted, the head 68 of the swingable leaf 28 occupies a plane distally offset relative to the common plane of the pair of flanges 60 such that the reactive thrust axis or medial plane of the head 68 is distally offset relative to the axis of the hinge pin 30. More specifically, using the proximal face 96 of the head 68 as a convenient reference, when the hinge is in the closed FIG. 10 condition the proximal face 96 is approximately co-planar with the axis of the hinge pin 30. Accordingly, the reactive force of the compressed follower 32 is absorbed along the reactive or medial axis of the head 68 distally relative to the axis of the pin 30. The gap between the cam surfaces, 42, 92 and the head edge 80 diminishes progressively in the FIG. 8 and 9 conditions as the hinge is opened. Accordingly, the follower 32 is further compressed as the door 24 is opened from the FIG. 10 condition to the FIG. 9 condition and still further compressed in the transition from the FIG. 9 to FIG. 8 condition and the reactive thrust axis of the head 68 exerts a stronger moment relative to the axis of the hinge pin 30.

FIG. 8 shows a door 24 held in a desired open adjusted position by a hinge 22 of the invention. In this condition, the follower 32 is symmetrically aligned with the head 68 and concave face 76 of the follower has stable engagement with the cam surface 42. Although the follower 32 has a low coefficient of sliding friction relative to the surface 42, the coefficient of static friction of the follower is increased by virtue of the maximum compression state of the follower 32, thus insuring that the door holds its desired adjusted position.

The self-closing action of the hinge 32 is illustrated in FIGS. 9 and 10. As the door 22 is moved from the position of FIG. 8 towards the FIG. 9 condition the follower 32 is advanced in a clock-wise direction, as viewed in the drawing, to a point where the leading or distal edge of the follower face 76 passes beyond the edge 92 of the pocket 90 in the sleeve portion 42. Approximately when the thrust axis of the head 68 moves in a clock-wise direction beyond the edge 92 the follower 32 becomes unstable and rolls on the edge 80, undergoing a pivot action or rocking movement about the radiused edge 92. At the same time, although the gap between the edge 80 and edge 92 has increased, the follower remains compressed and a self-closing moment 100 is thus produced in the door 22. The closing moment continues as door 24 arrives at and seats itself in the fully closed position indicated in FIG. 10. In the FIG. 10 condition, the follower 32 is arrested in an asymmetrically disposed condition relative to the head 68, which may be limited by mutual abutment between an inner face 84 of the follower pocket and the proximal side 96 of the head as well as by hinge pin 30.

Figure 11:
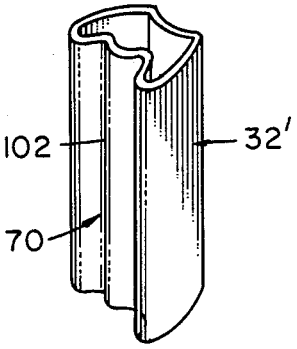
FIG. 11 is a perspective view of an alternative embodiment of the cam follower component.
Figure 12:
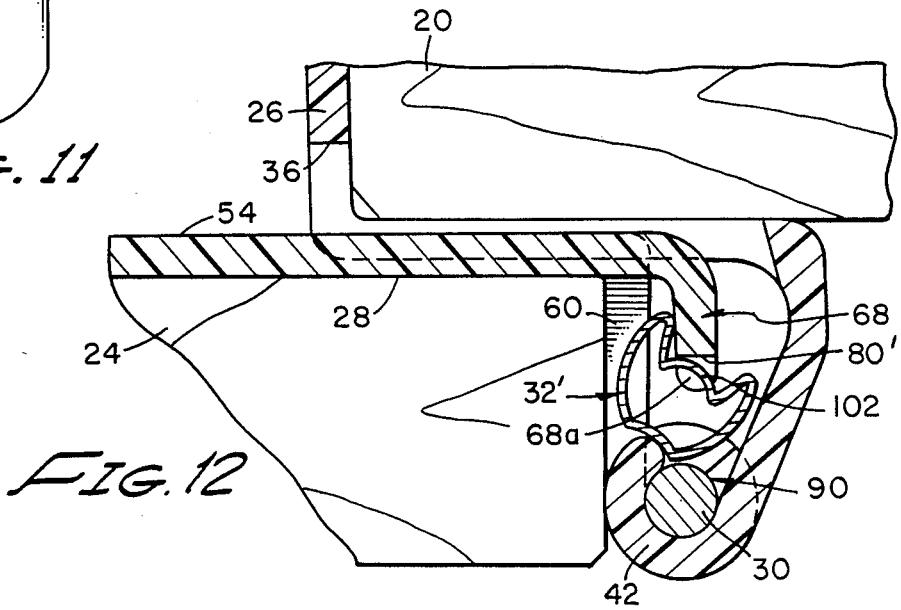
FIG. 12 is a view like FIG. 10 illustrating an alternative embodiment of the invention.

The alternative embodiment of the invention shown in FIGS. 11 and 12 is essentially the same as that of FIGS. 1–10 except for the means of engagement between the head 68 and follower 32. In this case, the head 68 is formed with an edge 80' that is flat, rather than semi-cylindrical as in the case of the first embodiment. The follower 32' is essentially the same as the follower 32 of the first embodiment except that the bottom of the pocket 70 comprises an upstanding longitudinally extending ridge 102 of arcuate convex cross section rather than the concave seat 82 of the first embodiment. The mode of operation of the alternative embodiment is substantially the same as that of the first embodiment.

It will be apparent that the hinge leaves are not limited to fabrication out of plastic materials and that for some applications the parts may be made of an appropriate metallic material, e.g., steel, aluminum or phosphor bronze. In addition, while steel is a preferred material for the follower 32, phosphor bronze may also be utilized, particularly in cases where the leaves are made of steel. However, the hinge which has been set forth in preferred embodiments above particularly lends itself to fabrication out of plastic materials which will avoid the cost involved in tempering spring portions of metallic hinge leaves, so that only a relatively small steel tube comprising the follower 32 need be tempered.

I claim:

1. A hinge assembly comprising:

a first leaf and a second leaf having sleeves in coaxial alignment with one another;

a hinge pin coaxially journaled within said sleeves for pivotally interconnecting said first leaf and said second leaf for angular movement relative to one another;

said first leaf having a head portion projecting substantially radially with respect to said hinge pin and with respect to said sleeve of said second leaf;

said sleeve of said second leaf being formed with a pocket that is aligned and in registration with said head portion of said first leaf when said first leaf is in a closed position relative to said second leaf, said pocket having an edge;

a follower means mounted between and in contact with both said head portion of said first leaf and said sleeve of said second leaf in a manner to be co-moveable with said first leaf relative to said second leaf; and a spring means operatively connected to said leaves for biasing said head portion in a direction substantially radially disposed to said hinge pin along an axis that is distally offset relative to the axis of said hinge pin;

contacting parts of said head portion, said follower and said sleeve of said second leaf having shape characteristics such that when said leaves are in a relatively open condition said follower is restrained by said sleeve of said second leaf against rocking movement relative to said head portion and such that when said head portion and said follower are rotated past said edge of said pocket said follower undergoes rocking movement relative to said head portion and relative to said edge of said pocket.

2. A hinge assembly as in claim 1 in which:

said follower means is a tubular member.

3. A hinge assembly as in claim 1 in which:

said spring means comprises a resiliently compressable material of said follower means.

4. A hinge assembly as in claim 3 in which:

said follower means is formed along one side with a cavity within which a terminal edge of said head portion is received, said cavity being internally formed with divergent opposite side walls to accomodate said rocking movement of said follower relative to said head portion of said first leaf.

5. A hinge assembly as in claim 4 in which:

opposite ends of said follower means and of said head portion have cooperating means to prevent displacement of said follower from said head portion in a direction parallel to said terminal edge of said head portion.

6. A hinge assembly as in claim 4 in which:

an external surface of said sleeve of said second leaf is formed with a substantially uniform radius.

7. A hinge assembly as in claim 4 in which:

said contacting parts of said head portion and said follower means comprise said terminal edge of said head portion and a seat defining a floor of said cavity of said follower means.

8. A hinge assembly as in claim 7 in which:

said seat of said cavity of said follower means is concave and said terminal edge of said head portion is hemispherical in cross section, said concave seat and said terminal edge having substantially the same radius.

9. A hinge assembly as in claim 7 in which:

said terminal edge of said head portion is flat and said seat of said cavity of said follower means comprises an arcuately shaped convex ridge, said flat edge of said head portion and said ridge having substantially line contact with one another.

10. A hinge assembly as in claim 6 in which:

said contacting parts of said follower means and said sleeve comprise an arcuate concave depression formed along one side of said follower means, said arcuate depression having a radius substantially like that of said external surface of said sleeve of said second leaf.

11. A hinge assembly comprising:

a rigid first leaf and rigid second leaf pivotally interconnected by a hinge pin;

said first leaf having a head portion projecting substantially radially with respect to said hinge pin;

said second leaf having a cam sleeve formed with a pocket, said pocket of said cam sleeve being aligned with and in registration with said head portion of said first leaf when said second leaf is in a closed position relative to said first leaf;

said pocket of said cam sleeve being defined along one side thereof by a terminal edge portion of an external surface of said cam sleeve that is parallel to a terminal edge of said head portion of said first leaf;

a follower means mounted between and in contact with both said terminal edge of said head portion of said first leaf and said external surface of said cam sleeve of said second leaf in a manner to be co-moveable with said first leaf relative to said second leaf, said follower means comprising a length of hollow tubing of a resilient material in a partially radially compressed state oriented parallel to said terminal edge of said head portion and said external surface of said cam sleeve;

the contacting parts of said head portion of said first leaf, said follower means, and said external surface of said cam sleeve having shape characteristics such that (a) when said leaves are in a relatively open condition, said follower means is restrained against rocking movement relative to said head portion of said first leaf and (b) such that when said head portion of said first leaf and said follower are rotated past said terminal edge of said pocket, said follower means undergoes rocking movement relative to said head portion of said first leaf and relative to said terminal edge of said pocket.

12. A hinge assembly as in claim 11 in which:

said contacting parts of said head portion and said follower means comprise said terminal edge of said head portion and a seat defining a floor of a cavity formed along one side of said follower means.

13. A hinge assembly as in claim 12 in which:

said cavity is internally formed with divergent opposite side walls to accomodate said rocking movement of said follower relative to said head portion.

14. A hinge assembly as in claim 13 in which:

said seat of said cavity of said follower means is concave and said terminal edge of said head portion is hemispherical in cross section, said concave seat and said terminal edge of said head portion having substantially the same radius.

15. A hinge assembly as in claim 13 in which:

said terminal edge of said head portion is flat and said seat of said cavity of said follower means comprises a convex arcuately shaped ridge, said flat edge of said head portion and said ridge having substantially line contact with one another.

16. A hinge assembly as in claim 11 in which:

said contacting parts of said follower means and said sleeve comprise an arcuate concave depression formed along one side of said follower means, said arcuate depression having a radius substantially like that of an external surface of said cam sleeve of said second leaf.

17. A hinge assembly as in claim 16 in which:

said edge of said pocket of said sleeve is formed with a radius less than that of said arcuate concave depression formed along one side of said follower means.

18. A hinge assembly as claim 11 in which:

said follower means is made of a material selected from the group consisting of steel and phosper bronze.

19. A hinge assembly as in claim 18 in which:

said first and second leaves are made of a synthetic plastic material.

* * * * *